US009812799B2

(12) United States Patent
Wittig

(10) Patent No.: US 9,812,799 B2
(45) Date of Patent: Nov. 7, 2017

(54) PRINTED CIRCUIT BOARD PLUG DEVICE HAVING A PRE-ADJUSTING DEVICE WHICH SERVES AS A LOCKING DEVICE

(71) Applicant: WÜRTH ELEKTRONIK ICS GMBH & CO. KG, Niedernhall (DE)

(72) Inventor: Klaus Wittig, Öhringen/Kappel (DE)

(73) Assignee: Wurth Elektronik ICS Gmbh & Co. KG, Niedernhall (DE)

( * ) Notice: Subject to any disclaimer, the term of this patent is extended or adjusted under 35 U.S.C. 154(b) by 0 days.

(21) Appl. No.: 15/021,653

(22) PCT Filed: Aug. 21, 2014

(86) PCT No.: PCT/DE2014/000427
§ 371 (c)(1),
(2) Date: Mar. 11, 2016

(87) PCT Pub. No.: WO2015/035967
PCT Pub. Date: Mar. 19, 2015

(65) Prior Publication Data

US 2016/0233598 A1 Aug. 11, 2016

(30) Foreign Application Priority Data

Sep. 13, 2013 (DE) ..... 10 2013 218 441

(51) Int. Cl.
*H01R 12/00* (2006.01)
*H01R 12/71* (2011.01)
(Continued)

(52) U.S. Cl.
CPC ..... *H01R 12/714* (2013.01); *H01R 12/515* (2013.01); *H01R 12/585* (2013.01);
(Continued)

(58) Field of Classification Search
CPC .... H01R 13/42; H01R 13/422; H01R 13/424; H01R 13/426; H01R 13/436
(Continued)

(56) References Cited

U.S. PATENT DOCUMENTS 7,878,834 B2 2/2011 Sherman et al.
8,632,346 B2 1/2014 Wittig et al.

FOREIGN PATENT DOCUMENTS

WO WO 2010/063459 A1 6/2010
WO WO 2012/107569 A1 8/2012

OTHER PUBLICATIONS

International Search Report corresponding to PCT/DE2014/000427, dated Jan. 30, 2015, 5 pages.

*Primary Examiner* — Vanessa Girardi
(74) *Attorney, Agent, or Firm* — Lewis Roca Rothgerber Christie LLP

(57) ABSTRACT

A direct plug device for directly plugging into a printed circuit board, the direct plug device comprising a plug element that comprises an accommodating housing and at least one pluggable, in particular spring-like, contact element accommodated at it; and a plug element receptacle which is designed to at least partially accommodate the plug element, which comprises a locking device and which can be moved relative to the plug element between a contact element-remote state and a contact element-proximal state; wherein the plug element comprises at least one pre-adjusting structure which is to be arranged at the side of the printed circuit board and which, when the plug element is placed onto the printed circuit board, can be connected to at least one corresponding pre-adjusting structure of the printed circuit board in such a way that, in the connected state, the at least one contact element is aligned with at least one correspondingly designed contact element opening of the printed circuit board; and
(Continued)

wherein the plug element receptacle can be displaced relative to the plug element, which is placed on the circuit board in a pre-adjusted manner, from the contact element-remote state to the contact element-proximal state in such a way that thereby the locking device and the pre-adjusting structure of the plug element are commonly locked to the pre-adjusting structure of the printed circuit board.

12 Claims, 9 Drawing Sheets

(51) Int. Cl.

| | |
|---|---|
| ***H01R 12/51*** | (2011.01) |
| ***H01R 12/58*** | (2011.01) |
| ***H01R 12/70*** | (2011.01) |
| ***H01R 13/502*** | (2006.01) |
| ***H01R 13/639*** | (2006.01) |
| ***H01R 13/627*** | (2006.01) |
| ***H01R 13/629*** | (2006.01) |

(52) U.S. Cl.
CPC ..... *H01R 12/7052* (2013.01); *H01R 12/7058* (2013.01); *H01R 12/7064* (2013.01); *H01R 12/7082* (2013.01); *H01R 13/502* (2013.01); *H01R 13/629* (2013.01); *H01R 13/6271* (2013.01); *H01R 13/6395* (2013.01)

(58) Field of Classification Search
USPC ..... 439/78, 82, 620.15, 711, 715, 717
See application file for complete search history.

108
110
114
200
102
112
116
112
102

108
112
102
120
102
140
112
114
106
110
118
112
102
200

108
114
120
110
140
200
116
112

200
122
102
112
116
116
112
102
122
114
110
120
110
106
108
118
122
122
102
112
116
116
112
102

108
120
112
140
114
106
112
200
110

108
120
118
106
110
112
116
112
114

PRINTED CIRCUIT BOARD PLUG DEVICE HAVING A PRE-ADJUSTING DEVICE WHICH SERVES AS A LOCKING DEVICE

CROSS-REFERENCE TO RELATED APPLICATIONS

This application is a National Phase Patent Application and claims priority to and the benefit of International Application Number PCT/DE2014/000427, filed on Aug. 21, 2014, which claims priority to and the benefit of German Provisional Patent Application No. 10 2013 218 441.7, filed Sep. 13, 2013, the entire contents of all of which are incorporated herein by reference.

FIELD OF THE INVENTION

Embodiments of the invention relate to a direct plug device for directly plugging onto a printed circuit board.

TECHNOLOGICAL BACKGROUND

An arrangement is known for electrically and mechanically connecting plug elements by means of a base to a printed circuit board which is designed for high electrical and mechanical requirements.

Further, connecting arrangements for printed circuit boards are known, which enable a direct plugging of a plug part onto a printed circuit board without a socket mounted on said printed circuit board.

WO 2012/107569 of the same applicant discloses a direct plug device for directly plugging onto a printed circuit board, wherein the direct plug device is a plug element which comprises an accommodating housing and a plurality of pluggable contact elements accommodated thereon. The direct plug device also comprises a plug element receptacle which is designed to at least partly accommodate the plug element in such a manner that in the accommodated condition of the plug element the plug element receptacle at least partially laterally covers the contact elements. The plug element receptacle comprises at least one at the side of the printed circuit board mounted pre-adjusting structure, which when the plug element is placed on the printed circuit board can be connected to at least one corresponding pre-adjusting structure of the printed circuit board, in such a way that in the connected state the contact elements are aligned with correspondingly designed contact element openings of the printed circuit board. The plug element is moveable relative to the plug element receptacle mounted in a pre-adjusted manner on the printed circuit board so as to enable the contact elements to be removed from the plug element receptacle and inserted into the correspondingly designed contact element openings.

Although such a connection arrangement has many advantages, handling of the relatively sensitive contact elements as well as positioning them correctly on the printed circuit board can be challenging for a user.

SUMMARY OF THE INVENTION

The underlying object of embodiments of the invention may be to create a direct plug device for directly plugging onto a printed circuit board, which is robust and easy for a user to handle.

Accordingly, there is proposed a direct plug device, a connection arrangement and a method having the features cited in the independent claims. Embodiments of the invention form the subject matter of dependent claims.

In accordance with an exemplary embodiment of the invention a direct plug device for plugging directly to a printed circuit board is provided, the direct plug device comprising a plug element that comprises an (in particular electrically insulating) accommodating housing and at least one (in particular electrically conductive) pluggable (in particular spring-like) contact element accommodated at it (in particular a plurality of such contact elements, wherein a contact element can also be designated as a direct plug contact); and a plug element receptacle (which can be designed in particular as a locking frame), that is designed to at least partially (in particular, circumferentially and laterally) accommodate the plug element, that comprises a locking device, and that can be moved (in particular longitudinally displaced) relative to the plug element between a contact element-remote state and a contact element-proximal state (wherein in the contact element-remote state the plug element receptacle and the at least one contact element are spaced further apart than in the contact element-proximal state), wherein the plug element comprises at least one pre-adjusting structure which is to be arranged at the side of the printed circuit board and which, when the plug element is placed onto the printed circuit board, can be connected to at least one corresponding pre-adjusting structure of the printed circuit board in such a way that, in the connected state, the at least one contact element is aligned with at least one correspondingly designed contact element opening (in particular a contact element plated through-hole) of the printed circuit board, and wherein the plug element receptacle can be moved relative to the plug element placed on the printed circuit board in a pre-adjusted manner from the contact element-remote state to the contact element-proximal state in such a way that thereby the locking device and the pre-adjusting structure of the plug element commonly (or in an interacting manner) are thereby locked to the pre-adjusting structure of the printed circuit board.

In accordance with another exemplary embodiment of the invention there is provided a connection arrangement which comprises a printed circuit board that has at least one pre-adjusting structure and at least one contact element opening, and a direct plug device with the features described above, which direct plug device is designed for plugging directly onto the printed circuit board by means of connecting the at least one pre-adjusting structure of the plug element to the at least one corresponding pre-adjusting structure of the printed circuit board and by means of a subsequent displacing of the plug element receptacle relative to the plug element and to the printed circuit board from the contact element-remote state to the contact element-proximal condition in such a way that the locking device and the pre-adjusting structure of the plug element are commonly locked at the pre-adjusting structure of the printed circuit board.

In accordance with a further exemplary embodiment of the invention there is provided a method for directly plugging a direct plug device onto a printed circuit board, wherein in said method a plug element is provided, that comprises an accommodating housing and at least one pluggable, in particular spring-like, contact element accommodated at it, the plug element is at least partially accommodated by a plug element receptacle which comprises a locking device and which is movable relative to the plug element between a contact element-remote state and a contact element-proximal state, the plug element is placed on the printed circuit board, thereby ensuring that at least one pre-adjusting structure of the plug element at the side of the printed circuit board is connected to at least one corresponding pre-adjusting structure of the printed circuit board in such a way that as a result of the connection the at least one contact element is aligned with at least one correspondingly designed contact element opening of the printed circuit board (and an electrically conductive contact is thereby preferably simultaneously formed between the at least one contact element and the at least one associated contact element opening), and the plug element receptacle is displaced relative to the plug element placed in a pre-adjusted manner on the printed circuit board from the contact element-remote state to the contact element-proximal state in such a way that the locking device and the pre-adjusting structure of the plug element are commonly locked to the pre-adjusting structure of the printed circuit board.

In accordance with one exemplary embodiment a manually pluggable and manually detachable system is provided, which enables a fault-robust electrical contact to be made between at least one sensitive contact element on the one hand and a printed circuit board on the other hand due to the fact that at least one pre-adjusting structure on a plug element with the at least one contact element is first placed onto at least one corresponding pre-adjusting structure of the printed circuit board. In this pre-adjustment process the at least one contact element can already be inserted into the at least one corresponding contact element opening of the printed circuit board and thereby preferably already form an electrically conducting contact. This ensures a mechanically correct fitting of the direct plug device on the printed circuit board and also preferably already accomplishes the electrical contact. The pre-adjustment process described is possible with very little physical effort, because the pre-adjustment does not cause any further locking of the direct plug device to the printed circuit board. By merely transferring an external plug element receptacle from a contact element-remote state respectively printed circuit board-remote state into a contact element-proximal state or printed circuit board-proximal state respectively, i.e. by moving the plug element receptacle in the direction of the printed circuit board without a simultaneous movement of the plug element, the at least one pre-adjusting structure of the plug element is wedged or anchored to the at least one pre-adjusting structure of the printed circuit board due to a corresponding action of the locking device of the plug element receptacle. Thus, a mechanically robust plugging and an electrical contact can be obtained with an intuitive and simple manual action, which reliably eliminates the possibility of incorrect adjustment. It is also no longer necessary to provide a socket on the printed circuit board, because the electrical contacting can be achieved directly between the contact element or the contact elements and an electrically conductive contact structure of the printed circuit board that can be provided in the contact element opening or the contact openings. By means of this measure it is simultaneously ensured a protection of the sensitive contacts against damage and also a reliable pre-adjustment between the direct plug device and the printed circuit board is provided.

Hereafter, additional configurations of the direct plug device, the connection arrangement and the method are described.

In general, in the context of this application a pre-adjusting structure can be understood as meaning any feature (physical structure, recess, colored marking, magnetic elements, etc.) on the plug element or printed circuit board that promotes a corresponding arrangement to a feature of the respective different pre-adjusting structure. In accordance with a preferred exemplary embodiment the at least one pre-adjusting structure of the plug element can have at least one pre-adjusting pin (i.e. a protrusion). The at least one corresponding pre-adjusting structure of the printed circuit board can have at least one pre-adjusting opening (for example a plated-through hole or blind hole). In particular, the pre-adjusting structure can be a pin and the corresponding pre-adjusting structure can be a corresponding pre-adjusting opening in the printed circuit board, which enables a form-fit interlocking engagement of the pre-adjusting opening by means of the pre-adjusting pin. It is also possible to provide a pre-adjusting pin at the printed circuit board and to provide the plug element with a pre-adjusting opening. It is preferable, however, to provide several pre-adjusting pins at the plug element and corresponding pre-adjusting openings at the printed circuit board, because this allows for a correct positioning to be pre-specified in a particularly intuitive manner and the printed circuit board can be produced and assembled as a flat structure.

In the contact element-proximal state the plug element and the plug element receptacle can be in a first semi-stable state (in particular in a first locked state) relative to each other. In the contact element-remote state the plug element and the plug element receptacle can be in a second semi-stable state (in particular in a second locked state) relative to each other. This means that the fact that the direct plug device is in a defined initial or final state can be displayed to a user by haptic means, which enables incorrect handling of the direct plug device to be prevented.

In accordance with one exemplary embodiment the plug element receptacle can be moveable from the contact element-remote state to the contact element-proximal state relative to the plug element, which is placed on the printed circuit board in a pre-adjusted manner, in such a way that the locking device acts mechanically on the pre-adjusting structure of the plug element such that the pre-adjusting structure of the plug element is thereby locked to the pre-adjusting structure of the printed circuit board. In particular, a longitudinal displacement of the locking device can lead to a sideways movement of the pre-adjusting structure of the plug element, so that a direction of the insertion force applied by a user is converted into a different direction of a locking force which is exerted on the pre-adjusting structure of the printed circuit board. A single intuitive plug movement by the user therefore also leads to a locking of the direct plug element at the printed circuit board, which locking can be realized in a force-saving design, but which locking is only releasable by applying a large expenditure of energy.

In accordance with one exemplary embodiment the at least one pre-adjusting structure of the plug element can comprise at least one pre-adjusting pin, and the at least one corresponding pre-adjusting structure of the printed circuit board can comprise at least one pre-adjusting opening. Such pre-adjusting pins can be pointed at their end to facilitate a simple insertion into the pre-adjusting opening of the printed circuit board. The formation of the pre-adjusting structures of the printed circuit board as pre-adjusting openings also favors a planar design of the printed circuit board, which can be particularly advantageously combined with a socket-free configuration.

In accordance with one exemplary embodiment the at least one pre-adjusting pin can have a lateral protrusion, which after passing the pre-adjusting pin through the printed circuit board and by moving the plug element receptacle from the contact element-remote state to the contact element-proximal state abuts against a rear side of the printed circuit board where it is locked to prevent removal. An interlocking fit between the pre-adjusting pin and the printed circuit board can be used to prevent any unwanted withdrawal of the direct plug device from the printed circuit board. The rear side of the printed circuit board is to be understood as a main surface of the printed circuit board, which, when the direct plug device is mounted on the printed circuit board, faces away from the majority of the direct plug device, and is arranged facing towards or adjacent to the ends of the pre-adjusting pin. The lateral protrusion can be a kind of barbed hook, which has an impingement surface that impinges against the rear side of the printed circuit board if an attempt is made to remove the direct plug device from the printed circuit board before releasing the locking mechanism (i.e. before retracting the plug element receptacle relative to the plug element and into the contact element-remote state).

In accordance with one exemplary embodiment the locking device can have at least one locking pin at its end, which penetrates into the at least one pre-adjusting opening next to the at least one pre-adjusting pin, when the plug element receptacle is moved from the contact element-remote state to the contact element-proximal state, and which together with the respective pre-adjusting pin activates the locking mechanism. In particular, the clamping of the locking pin and the pre-adjusting pin in the pre-adjusting opening can take place together. In other words, before the locking takes place only the pre-adjusting structure of the direct plug device penetrates the pre-adjusting opening of the printed circuit board and in this state it can still be removed with little effort. Due to the locking operation triggered by displacement of the plug element receptacle relative to the plug element, the respective locking pin next to the respective pre-adjusting pins is inserted into the pre-adjusting opening of the printed circuit board and causes two things to happen: firstly the locking pin presses the pre-adjusting pin elastically against the walls of the pre-adjusting opening and can thereby lock or clamp, for example, the side protrusion behind the printed circuit board. This can also cause a positive-fitting or friction closure between the pre-adjusting pin and the walls of the pre-adjusting opening, or the pre-adjusting pin to be wedged or clamped in the pre-adjusting opening. Secondly, the locking pin at least partially fills a cavity of the pre-adjusting opening that remains even after the pre-adjusting pin is inserted, and is therefore itself wedged or clamped together with the pre-adjusting pin by an interlocking or friction fit against the walls of the pre-adjusting opening. In this operating state, a removal of the direct plug device from the printed circuit board is only possible with an exceptionally high level of effort (or even no longer possible without destroying the device). Only when the plug element receptacle is withdrawn into the printed circuit board-remote or contact hole-remote state the locking pin is pulled out of the pre-adjusting opening, and the above two wedging actions are made simultaneously and reversibly.

In accordance with one exemplary embodiment the at least one contact element can protrude relative to the accommodating housing at the side of the printed circuit board side (in particular such that it is non-displaceable in the plugging direction and/or elastically moveable perpendicular to the plugging direction). A mechanism which implements an insertion of the contact elements into the accommodating housing or a removal of the contact elements from the housing is therefore unnecessary. In other words, in each operating state of the direct plug device the contact elements protrude statically beyond the housing. The at least one contact element can preferably only be moved elastically in a direction perpendicular to the insertion direction, so that the spring action of the contact element further reinforces the locking effect of the direct plug device on the printed circuit board in the connected state and a continuous electrically conductive connection between the contact element and the contact element opening is further promoted. If the contact elements protrude in a non-displaceable manner relative to the accommodating housing, a preferably planar end face of the accommodating housing, from which the contact elements project, also serves as a stop surface during the pre-adjusting insertion of the direct plug device into the printed circuit board with the plug element receptacle retracted.

In accordance with one exemplary embodiment the at least one pre-adjusting structure of the plug element can extend protectively beyond the at least one contact element. If the pre-adjusting structure of the plug element, which is in particular designed as a pre-adjusting pin, protrudes further relative to the accommodating housing than the contact elements, then the sensitive electrically conductive contact elements can be protected by the pre-adjusting pin from unwanted mechanical damage caused by impact with the environment. This applies in particular when a plurality of pre-adjusting pins are arranged along a periphery of the contact elements and therefore protect the contact elements against mechanical damage over their whole extent. For example, four pre-adjusting pins can be mounted at the four corners of a rectangle-shaped, matrix-like arrangement of contact elements, in order to ensure protection of the contact elements from a mechanical impact from any direction.

In accordance with one exemplary embodiment the at least one pre-adjusting structure of the plug element can be designed to be elastic (in particular being formed from an inherently elastic material or mounted in a spring loaded manner), such that a displacement of the plug element receptacle from the contact element-remote state to the contact element-proximal state causes the locking device to slide along the spring-like pre-adjusting structure of the plug element, and at the same time spreading this locking device perpendicular to, or at least at an angle with respect to the direction of travel, against the pre-adjusting structure of the printed circuit board. The movement of the locking device along a longitudinal axis (in particular in the insertion direction) can therefore result in a mechanical action on pre-adjusting pins of the direct plug device that are arranged slightly inclined thereto, causing these pre-adjusting pins to be elastically pushed aside, which can at least provide a contribution to the locking effect.

In accordance with one exemplary embodiment the plug element can comprise a plurality of pre-adjusting structures along its circumference, which by movement of the plug element receptacle from the contact element-remote state to the contact element-proximal state of the locking device are locked to a plurality of pre-adjusting structures of the printed circuit board. The fact that pre-adjusting structures are mounted, in particular over the whole extent of the direct plug device, enables a symmetrical handling of the plug device avoiding force spikes to be obtained. It is precisely by providing two, and in particular more than two, pre-adjusting structures that a faulty insertion of the direct plug device into the printed circuit board can be rendered mechanically impossible, as this can be ruled out by a fault-robust shape encoding.

In accordance with one exemplary embodiment the pre-adjusting structures of the plug element and the locking device can be matched to each other in such a way that locking forces act on different pre-adjusting structures of the plug element act in different directions, in particular in pairs of opposite directions, for example. For example, sliding the plug element receptacle forwards relative to the plug element effects a forward displacement of different locking pins parallel to each other, and thus simultaneously an outward spreading of all pre-adjusting structures of the plug element, which consequently applies a force leading to an efficient locking action. This can also be used to ensure protection against unwanted disconnection of the direct plug device from the printed circuit board in different directions.

In accordance with one exemplary embodiment the plug element can have a (for example frame-like) pre-adjusting housing, which is arranged in a spring-like manner between the housing and the plug element receptacle and to which the at least one pre-adjusting structure of the plug element is attached, for example being molded at as an integral piece and/or from the same material. Both the pre-adjusting housing and the plug element receptacle can be arranged in a frame-like manner around the accommodating housing, which for example is closed at all sides.

In accordance with one exemplary embodiment the pre-adjusting housing can be connected to the accommodating housing by means of at least one spring-like bridge element (in particular as an integral part or more particularly, made of the same material). The pre-adjusting housing and the accommodating housing can thus be weakly mechanically coupled to each other, for example by means of one or more elastic connecting elements, such as for example plastic lands. This enables a compensatory motion between the at least one locking structure of the plug element and the at least one contact element, which is advantageous for the plugging and locking operation. For example, both the accommodating housing and the pre-adjusting housing can be produced by injection molding and/or from plastic material, and assembled to form a common component. This allows for a cost-effective manufacture and an error robust operation of the direct plug device.

In accordance with one exemplary embodiment the accommodating housing may consist of two, three or more sub-housings that can be mechanically plugged together such that spaces for accommodating the contact elements are left between sub-housings that are joined together. This allows the contact elements (for example with attached cable connections or the like) to be inserted into the accommodating spaces, and subsequently clamped to the accommodating housing by plugging together the associated sub-housings. Associated sub-housings can comprise, for example, mutually inverse rectangular profiles, between which a simply designed and reliable plug connection can be produced. Sub-components of the pre-adjusting housing can be integrally formed at two edge-mounted sub-housings of the accommodating housing and elastically connected to it by means of the bridging elements. With one or more optional central sub-housings between the two edge-mounted sub-housings, the number of the desired contact elements can then be scaled to any desired size.

In accordance with one exemplary embodiment, the pre-adjusting housing can have at least one guide groove (each in particular being positioned next to the associated pre-adjusting structure), along which the locking device of the plug element receptacle can be moved in a guided manner by an exertion of a locking force on the at least one pre-adjusting structure of the plug element. By means of such guide grooves an interaction between the plug element and plug element receptacle can be precisely defined and any incorrect use of the direct plug device is rendered almost impossible. Guide rails of the locking device can slide along the guide groove, which guide rails can be rigidly coupled to locking pins at the end of the locking device and thus follow the movement of the guide rails along the guide grooves.

In accordance with one exemplary embodiment the plug element receptacle can be displaceable from the contact element-remote state to the contact element-proximal state relative to the plug element, which is placed on the circuit board in a pre-adjusted manner, in such a way that the locking device locks the pre-adjusting structure of the plug element to the pre-adjusting structure of the printed circuit board with an interlocking and/or force-fitting and/or friction connection. This enables a powerful holding force to be applied, which is only removed again by withdrawing the plug element receptacle relative to the plug element and the printed circuit board, which then enables the direct plug device to be removed from the printed circuit board with a small amount of force.

In accordance with one exemplary embodiment the plug element and the plug element receptacle can therefore be designed in such a way that, starting from a state in which the locking device locks the pre-adjusting structure of the plug element to the pre-adjusting structure of the printed circuit board, the plug element receptacle can be moved back from the contact element-proximal state into the contact element-remote state in such a way that the lock is released and the plug element can then be disconnected from the printed circuit board with low force. This consequently enables both a low-force assembly of the direct plug device at the printed circuit board and a low-force removal of the direct plug device from the printed circuit board, but on the other hand, a removal of the direct plug device from the printed circuit board in the plugged and locked state with exertion of normal force is rendered impossible.

In accordance with one exemplary embodiment the plug element and the plug element receptacle can be matched to one another in such a way that a printed circuit board contact surface (in particular one that is interrupted only by the contact elements and otherwise essentially contiguous) of the accommodating housing and a printed circuit board contact surface (in particular one which is annular and surrounds the printed circuit board contact surface of the accommodating housing) of the plug element receptacle are coplanar in the contact element-proximal state. In the contact element-proximal state, i.e. in the pre-adjusted and locked state of the direct plug device, both printed circuit board contact surfaces therefore rest in contact on a planar mating surface of the printed circuit board and thus form a mechanically stable and defined configuration. In the contact element-remote state (for example in a pre-adjusted but not yet locked state) the two printed circuit board contact surfaces can be parallel offset relative to each other. A correct pre-adjusting state (but still without locking) can therefore be visually verified by a user by the fact that in this state the accommodating housing rests with its printed circuit board contact surface directly at the printed circuit board. A correct locking state can be visually verified by a user by the fact that in this state the plug element receptacle also rests directly at the printed circuit board.

In accordance with one exemplary embodiment the plug element receptacle can be made from an electrically insulating material, in particular plastic. The plug element, with the exception of the contact elements which are preferably made of metal, can also be manufactured from plastic. The plug element receptacle and components of the accommodating housing and optionally the lock housing can all be produced by injection molding. The electrically conductive contact elements can be electrically coupled in the inside of the accommodating housing of the plug element with cables or the like, by means of which the printed circuit board can be coupled with an electronic periphery. The contact elements themselves can be formed out of a stamped and bent sheet metal plate.

In accordance with one exemplary embodiment the printed circuit board can be socket-free, at least in a region in which the attachment between the direct plug device and the printed circuit board takes place. This results in an even and compact construction and assembly.

Further features, details and benefits of aspects of embodiments of the invention arise from the specific exemplary embodiments described hereafter with reference to the drawing, as well as from the claims.

DETAILED DESCRIPTION OF THE DRAWING

The features described in the case of one embodiment are also valid for the other embodiments. In the drawings.

Hereafter, exemplary embodiments of the invention are described with reference to the figures.

DETAILED DESCRIPTION OF EXEMPLARY EMBODIMENTS

Figure 1:
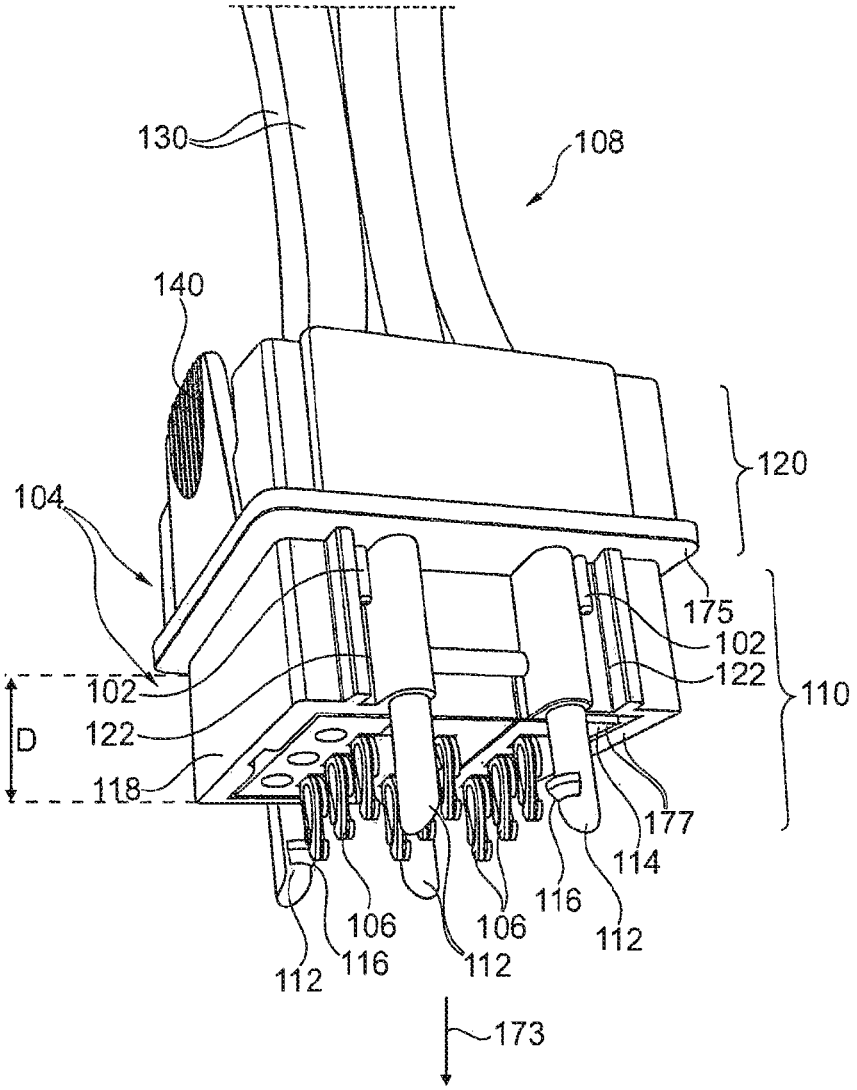
FIG. 1 shows a spatial view of a direct plug device in accordance with one exemplary embodiment, in which a plug element receptacle is pushed back relative to a plug element into a contact element-remote state.
Figure 3:
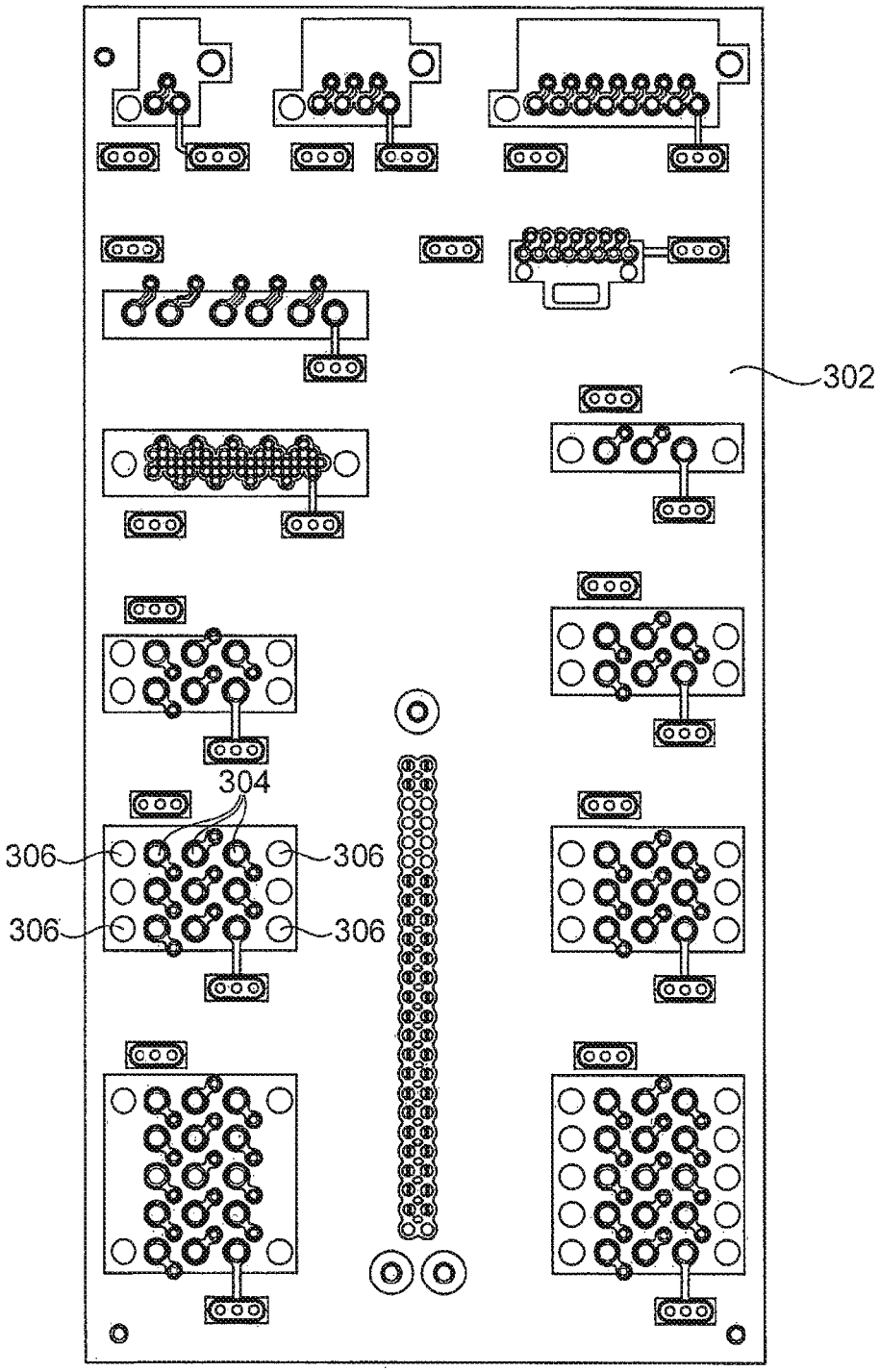
FIG. 3 shows a plan view of a printed circuit board for a connection arrangement in accordance with an exemplary embodiment of the invention, wherein the printed circuit board is configured for interacting with the direct plug device shown in FIG. 1 and FIG. 2.

FIG. 1 shows a spatial view of a direct plug device 108 in accordance with an exemplary embodiment for directly plugging onto a printed circuit board 302 in a socket-free manner (see FIG. 3). A frame-shaped plug element receptacle 120 of the direct plug device 108 in the operating state shown in FIG. 1 is in a contact element-remote state relative to a box-shaped plug element 110, as indicated with reference number 104. In other words, the plug element receptacle 120 is pushed back relative to the plug element 110 as far as to a rear locking position, such that a maximum distance D is formed between a printed circuit board contact surface 175 of the plug element receptacle 120 and a printed circuit board contact surface 177 of the plug element 110, wherein contact elements 106 extend out of the printed circuit board contact surface 177 of the plug element 110. The distance D can be, for example, 1 cm. In the state shown in FIG. 1 the direct plug device 108 is ready to operate, in order to be plugged into the printed circuit board 302 for pre-adjustment.

The direct plug device 108 comprises the plug element 110, which comprises a central accommodating housing 114 made of plastic and a matrix-like arrangement of here nine electrically conductive spring-like contact elements 106 (according to the exemplary embodiment shown implemented as a double yoke spring structure). The contact elements 106 protrude relative to the accommodating housing 114 on the printed circuit board side and are non-displaceable relative to the accommodating housing 114 in the insertion direction 173. Each of the contact elements 106 in the inside of the accommodating housing 114 is electrically conductively coupled to a respective one of cables 130 (not shown), on order to transmit an electrical signal between a respective cable 130 and a respective contact at the printed circuit board 302.

The plug element 110 has a pre-adjusting housing 118, which is arranged in a spring-like manner between the accommodating housing 114 and the plug element receptacle 120 and at which the pre-adjusting structure 112 of the plug element 110 is integrally formed. The pre-adjusting housing 118 is connected by means of elastic bridge elements to the outside of the housing 114.

The plug element receptacle 120 of the direct plug device 108 is designed for accommodating the plug element 110 in a partial, circumferentially surrounding manner. The plug element receptacle 120 comprises a locking device 102 in the form of four locking pins or locking pegs mounted in four corner regions. The entire plug element receptacle 120, together with the locking device 102 rigidly attached thereto, is displaceable relative to the plug element 110 between the contact element-remote state 104 (see FIG. 1, D=1 cm) and a contact element-proximal state 200 (see FIG. 2, distance D=0), wherein in the contact element-proximal state 200 the printed circuit board contact surface 175 of the plug element receptacle 120 and the printed circuit board contact surface 177 of the plug element 110 lie or are aligned flush with one another in a common printed circuit board contact plane. In order to transfer the direct plug device 108 between the two operating states shown in FIG. 1 and FIG. 2, a user can grasp handling pieces 140 that are integrally formed at an outer side of the plug element receptacle 120.

The plug element 110 in the exemplary embodiment shown has four pre-adjusting structures 112, which are to be arranged at the side of the printed circuit board during assembly and which are designed as pre-adjusting pins, which are mounted at four corners of an imaginary rectangle and which can be connected to corresponding pre-adjusting structures 306 of the printed circuit board 302 when the plug element 110 is placed on the printed circuit board 302. Since in the exemplary embodiment shown the pre-adjusting structures 306 of the printed circuit board 302 are designed as pre-adjusting openings (see FIG. 3), during the pre-adjustment the pre-adjusting pins are inserted into these pre-adjusting openings, but without initially being fixed to them with full operating stability. The established preliminary connection, however, is configured such that in this state the contact elements 106 are correctly aligned to correspondingly designed contact element openings 304 of the printed circuit board 302 (see FIG. 3). The contact elements 106 do project less far across the printed circuit board contact surface 177 of the accommodating housing 114 in the direction of the printed circuit board 302 as do the pre-adjusting structures 112. The pre-adjusting structures 112 of the plug element 110 thus extend beyond the contact elements 106 in the direction of the printed circuit board 302 in a protective manner. The contact elements 106 therefore only enter the contact element openings 304 once the pre-adjusting structures 112 have entered the pre-adjusting structures 306, hence only at the end of the pre-adjustment. Since at the lateral side the contact elements 106 are formed elastically, they automatically press against the metallized walls of the contact element openings 304 of the printed circuit board 302 and thereby ensure a reliable and interruption-free electrical coupling of the contact elements 106 with a corresponding wiring of the printed circuit board 302. This allows the mechanical pre-adjustment and the electrical contact between the direct plug device 108 and the printed circuit board 302 to be effected simultaneously and with a common hand movement, without a vibration-resistant and operationally stable attachment force being applied between the direct plug device 108 and the printed circuit board 302.

The plug element receptacle 120 can be subsequently displaced relative to the plug element 110, which is placed on the printed circuit board 302 in a pre-adjusted manner, from the contact element-remote state 104 to the contact element-proximal state 200 in such a way that the locking device 102 and the pre-adjusting structure 112 of the plug element 110 are locked to the pre-adjusting structure 306 of the printed circuit board 302. In other words, after the pre-adjustment and the electrical contacting all a user then needs to do is move the plug element receptacle 120 towards the plug element 110 and the printed circuit board 302 by the distance D, until an annular impingement surface in the form of the printed circuit board contact surface 175 of the plug element receptacle 120 impinges at the printed circuit board 302, which at this point is planar.

By means of this simple displacement operation (which can be accompanied by latching between plug element 110 and plug element receptacle 120 simultaneously with the impinging of the printed circuit board contact surface 175 at the printed circuit board 302), a clamping attachment force is generated, as is further described below, between direct plug device 108 and printed circuit board 302, which clamping attachment force is many times greater than the insertion force that must be applied for assembly and thus provides protection against unwanted or unintentional disconnection of the direct plug device 108 from the printed circuit board 302.

Each of the pre-adjusting pins of the pre-adjusting device 112 has a lateral protrusion 116, which, after the associated pre-adjusting pin has been passed through the printed circuit board 302 and by the plug element receptacle 120 being moved from the contact element-remote state 104 to the contact element-proximal status 200, is clamped against a rear side of the printed circuit board 302 in a locking manner. This is facilitated by the configuration of the locking device 102 described hereafter: the locking device 102 is embodied in the form of four locking pegs or locking pins at its end, each of which is inserted, when the plug element receptacle 120 is moved from the contact element-remote state 104 into the contact element-proximal state 200, into the associated pre-adjusting opening 306 next to and with one of the four associated pre-adjusting pins of the pre-adjusting device 112, and together with the respective pre-adjusting pin causes the locking action. This results in a joint clamped locking of the locking pin of the locking device 102 and of the pre-adjusting pin of the pre-adjusting device 112 in the pre-adjusting opening 306. The pre-adjusting housing 118 has guide grooves 122, along which the locking pegs or locking pins of the locking device 102 of the plug element receptacle 120 can be moved in a guided manner by the exertion of a locking force on the associated pre-adjusting locking pins of the pre-adjusting structure 112 of the plug element 110. The locking pins are moved by pushing the plug element receptacle 120 forward by the distance D in the direction of the printed circuit board 302. At this point the pre-adjusting pins are already located in the pre-adjusting openings with clearance. As a result of the forward motion the locking pins fill up a free space in the pre-adjusting openings and are thereby placed into the pre-adjusting openings next to the pre-adjusting pins. During this forward movement the locking pins press the pre-adjusting pins sideways against the wall and thus lock the pre-adjusting pins in the pre-adjusting openings. At the same time in a synergistic manner the locking pins also press against the wall in the pre-adjusting openings, because the diameter of locking pin plus pre-adjusting pin is slightly larger than the diameter of the pre-adjusting openings. The pre-adjusting structure 112 of the plug element 110 is thus designed in a spring-like manner, such that by displacing the plug element receptacle 120 from the contact element-remote state 104 to the contact element-proximal state 200, the locking device 102 slides down at the spring-mounted pre-adjusting structure 112 of the plug element 110 and thereby presses the spring-mounted pre-adjusting structure 112 against the pre-adjusting structure 306 of the printed circuit board 302 perpendicular to the direction of travel. The pre-adjusting structure 112 of the plug element 110 and the locking device 102 are matched to one another in such a way that locking forces act in different directions in different pre-adjusting structures 306. In the example shown, the pre-adjusting pins are all spread outward by the movement of the locking pins.

The plug element 110 and the plug element receptacle 120 are designed in such a way that, starting from the state in which the locking device 102 locks the pre-adjusting structure 112 of the plug element 110 to the pre-adjusting structure 306 of the printed circuit board 302, the plug element receptacle 120 can be moved back from the contact element-proximal state 200 to the contact element-remote state 104 in such a way that the lock is released and the plug element 110 can then be disconnected from the printed circuit board 302 with a small amount of force. The attachment or locking mechanism is therefore reversibly designed.

Figure 2:
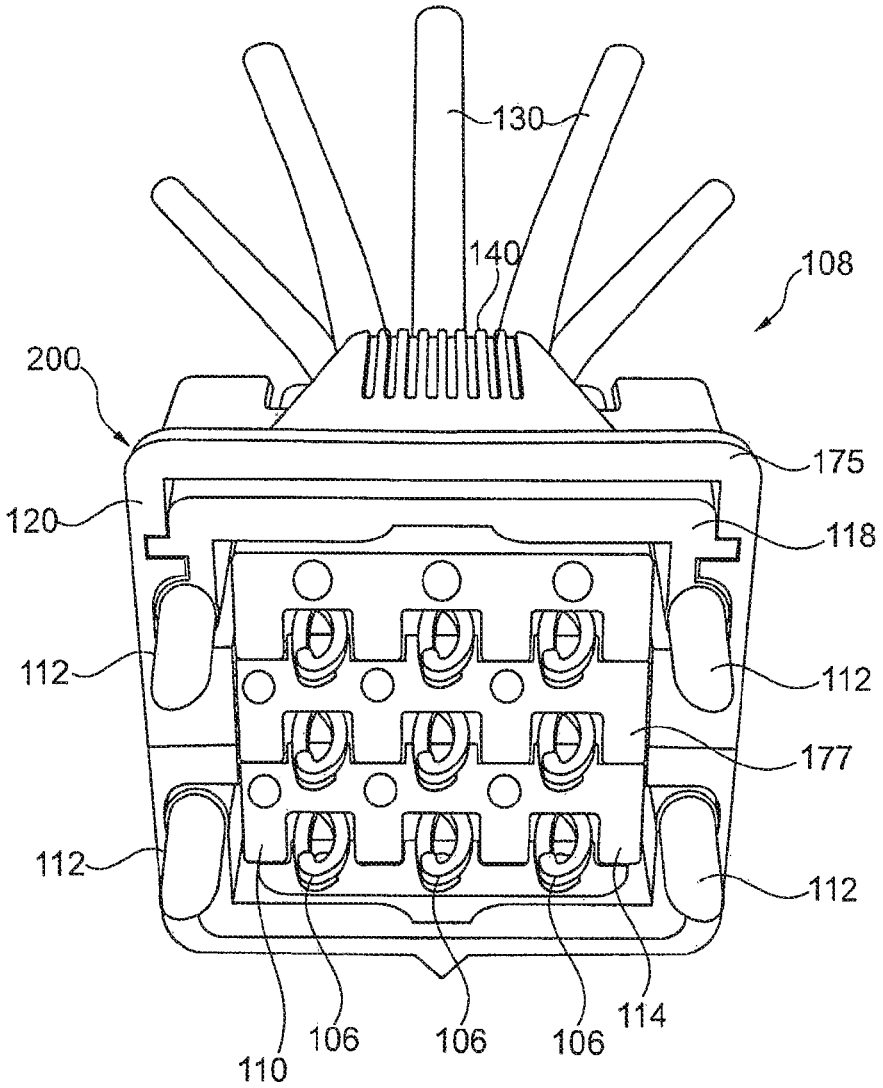
FIG. 2 shows a spatial view of the direct plug device in accordance with FIG. 1, in which the plug element receptacle is shifted relative to the plug element into a contact element-proximal state.

FIG. 2 shows a spatial view of the direct plug device 108 in accordance with FIG. 1, in which the plug element receptacle 120 is located in the contact element-proximal state relative to the plug element 110, as indicated with reference number 200. In other words, the plug element receptacle 120 has been displaced relative to the plug element 110 as far as a forward latching position at the side of the contact such that a minimum distance remains between the plug element receptacle 120 and the contact elements 106 at the contact surface of the plug element 110. In the operating state shown in FIG. 2 the annular end face (i.e. the printed circuit board contact surface 175) of the plug element receptacle 120 and the contact or impingement surface (i.e. the printed circuit board contact surface 177) of the accommodating housing 114 are flush.

FIG. 3 shows a plan view of the printed circuit board 302, which together with the direct plug device 108 according to FIG. 1 and FIG. 2 is configured to form a connection arrangement 400 (see FIG. 4) in accordance with an exemplary embodiment of the invention. In FIG. 3 also the pre-adjusting structures 306 and the contact element receptacles 304 are shown. In a region in which the direct plug device 108 is to be attached to the printed circuit board 302 (compare reference numbers 304, 306), the printed circuit board 302 has no sockets, but is perfectly planar there. Therefore, the direct plug device 108 can be mounted on a planar section of the printed circuit board 302 using direct insertion.

Figure 4:
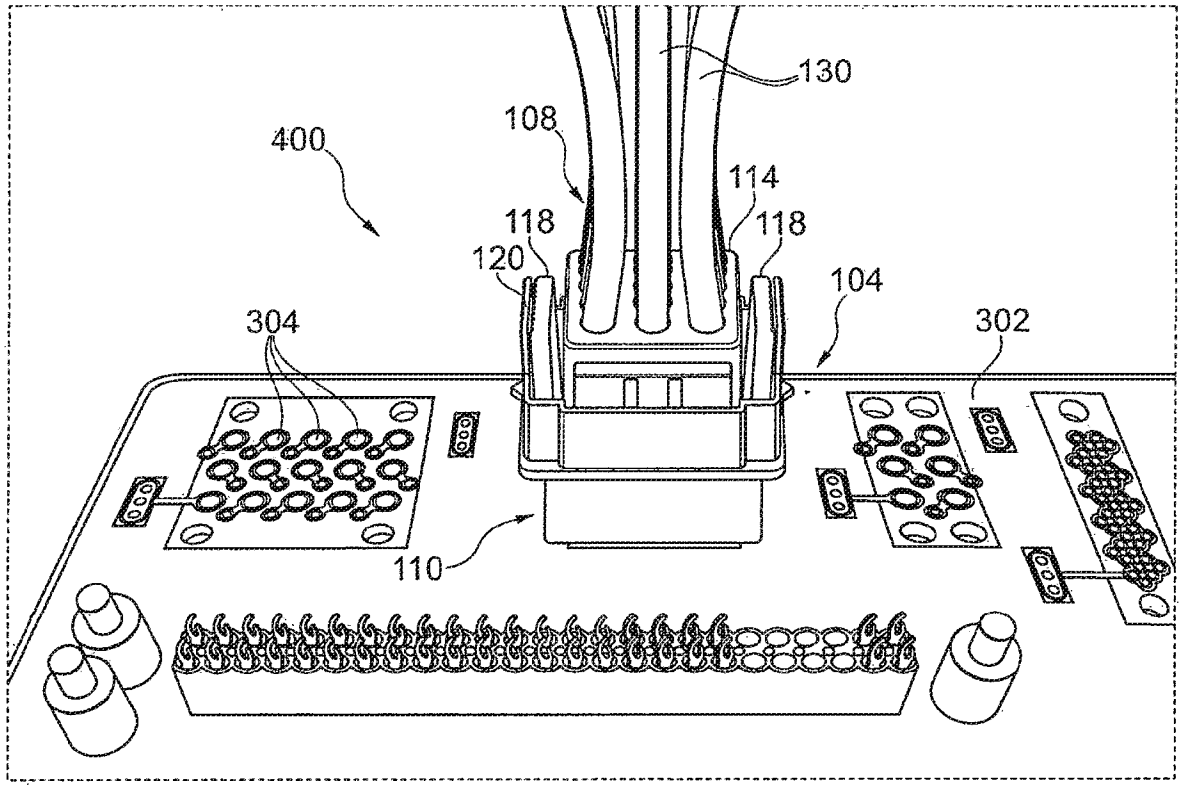
FIG. 4 shows a spatial view of a connection arrangement in accordance with an exemplary embodiment with a direct plug device according to FIG. 1 or FIG. 2 and with a printed circuit board in accordance with FIG. 3, wherein the plug element receptacle is in a contact element-remote state.

FIG. 4 shows a spatial view of the connection arrangement 400 in accordance with an exemplary embodiment with a direct plug device 108 according to FIG. 1 or FIG. 2, and with a printed circuit board 302 in accordance with FIG. 3, in which the plug element receptacle 120 is in a contact element-remote state 104, as described above.

Figure 5:
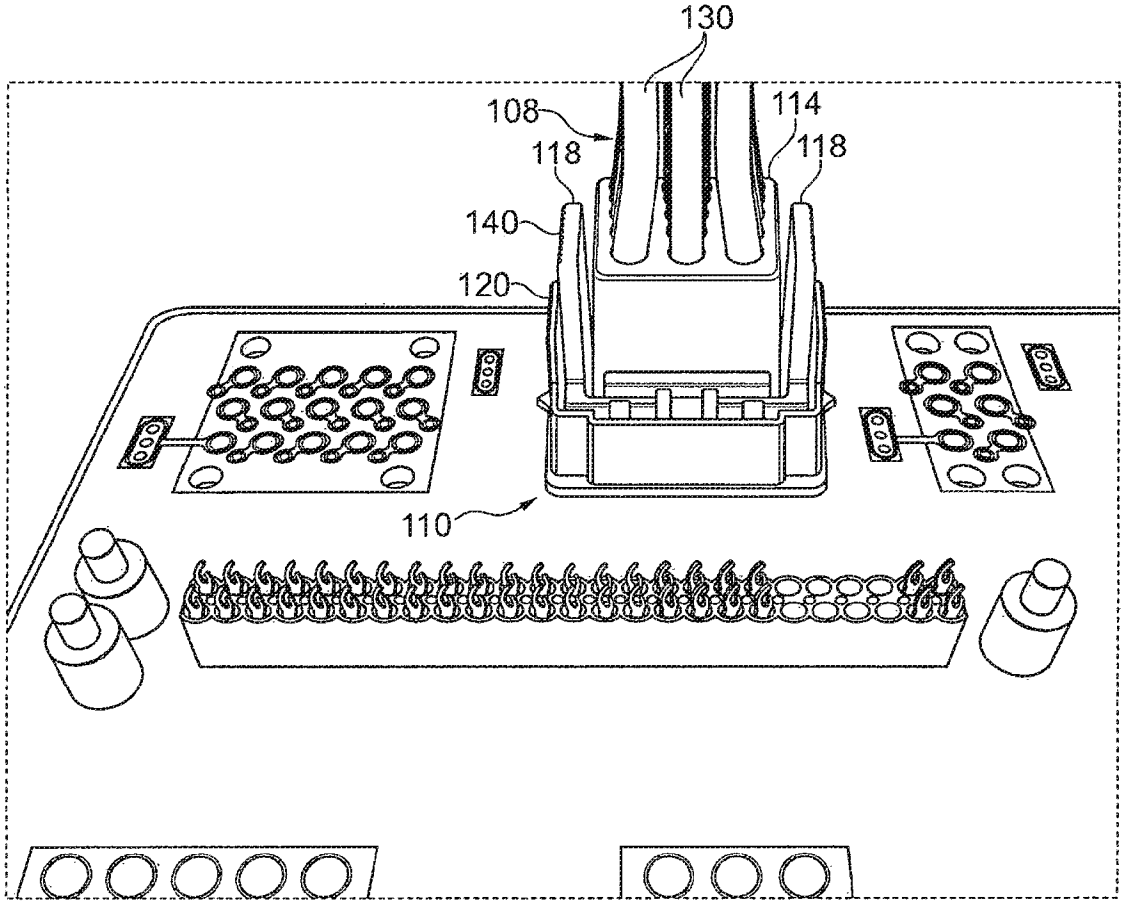
FIG. 5 shows a spatial view of the connection arrangement in accordance with FIG. 4, in which the plug element receptacle is in a contact element-proximal state.

FIG. 5 shows a spatial view of the connection arrangement 400 in accordance with FIG. 4, in which the plug element receptacle 120 is in the contact element-proximal state 104, as described above.

Figure 6:
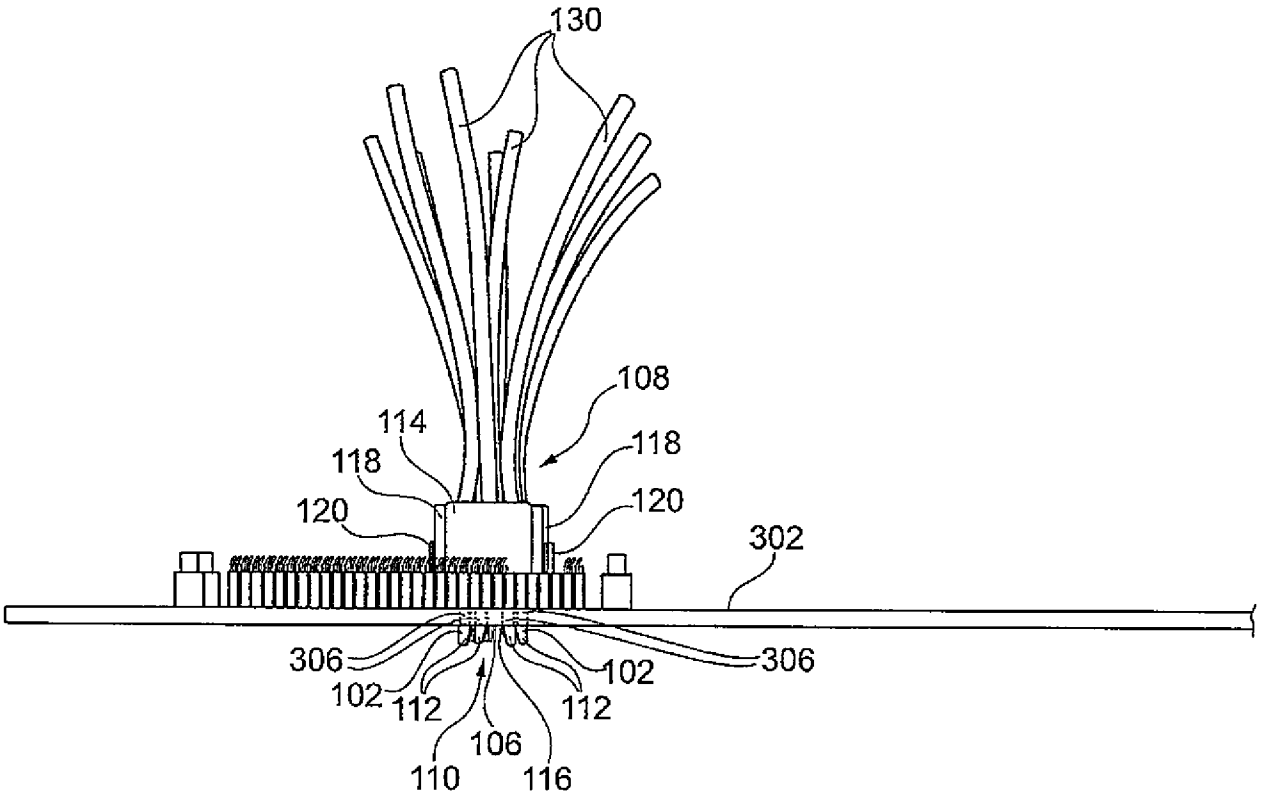
FIG. 6 shows a side view of the connection arrangement in accordance with FIG. 5.

FIG. 6 shows a side view of the connection arrangement 400 in accordance with FIG. 5. FIG. 6 also shows how the lateral protrusions 116 of the pre-adjusting structure 112, in a manner similar to a barbed hook at a rear side of the printed circuit board 302, prevent an unwanted removal.

Figure 7:
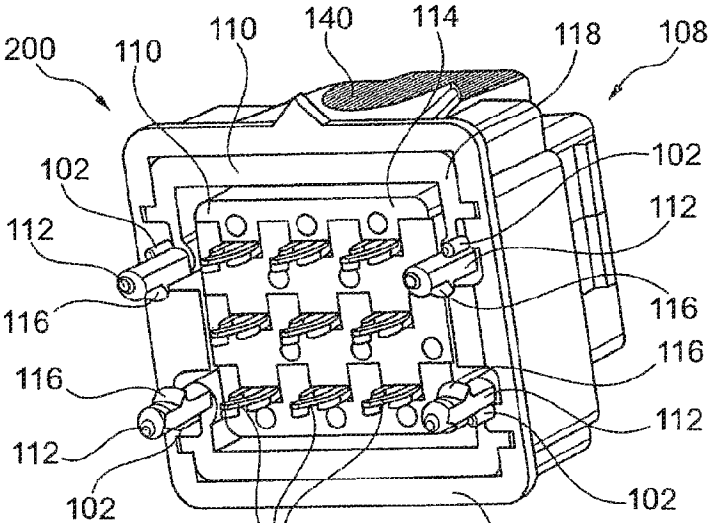
FIG. 7 shows a spatial view of the nine-pin direct plug device in accordance with the previous figures.

FIG. 7 shows a spatial view of the nine-pole direct plug device 108 in accordance with FIG. 1 to FIG. 6.

Figure 8:
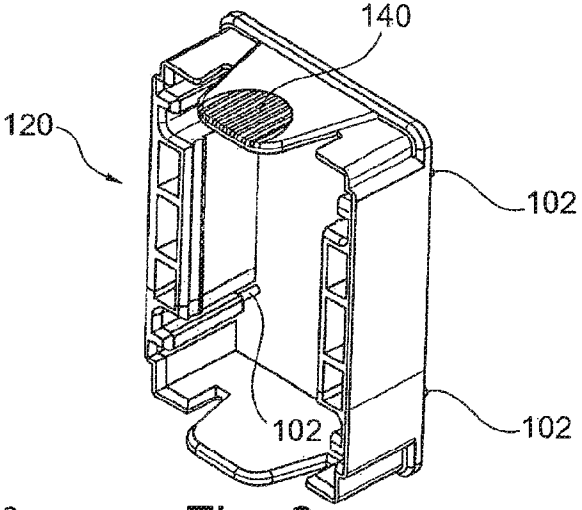
FIG. 8 shows a spatial view of the plug element receptacle in accordance with the previous figures.

FIG. 8 shows a spatial view of the plug element receptacle 120 in accordance with FIG. 1 to FIG. 6.

Figure 9:
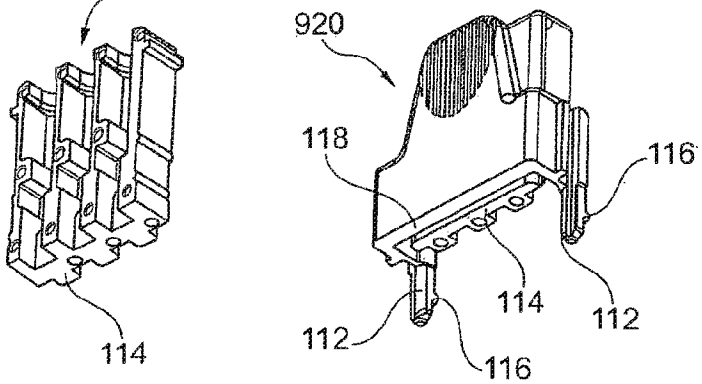
FIG. 9 shows a spatial view of three sub-housings which can be plugged together to form the plug element of the direct plug device in accordance with the previous figures.
Figure 9:
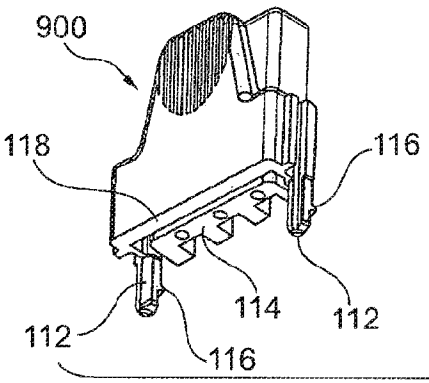
Figure 12:
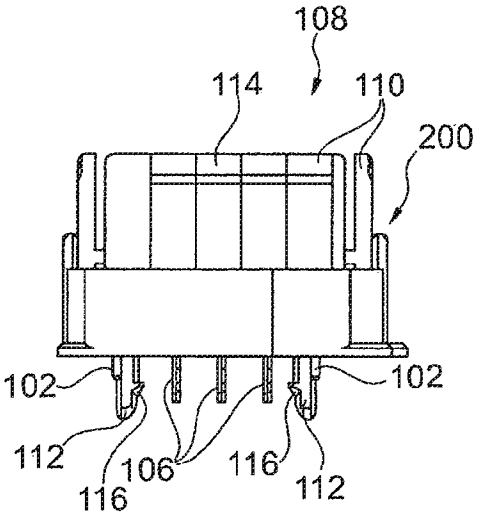
FIG. 10 to FIG. 15 show different views of a direct plug device in accordance with another exemplary embodiment in which the connector and receptacle are in a 15-pole configuration.
Figure 15:
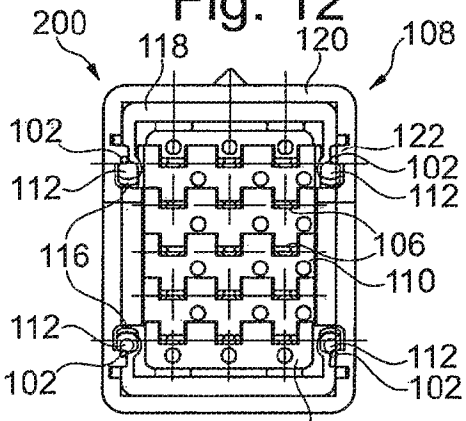
Figure 11:
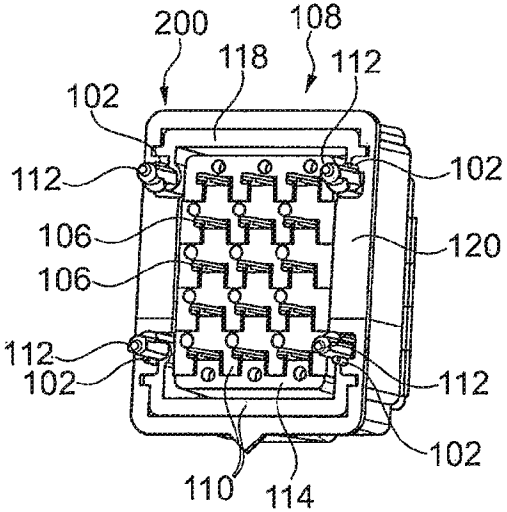
Figure 14:
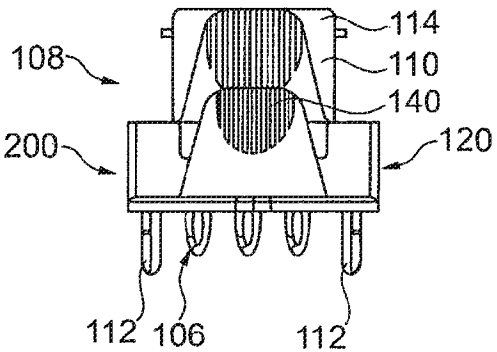
Figure 10:
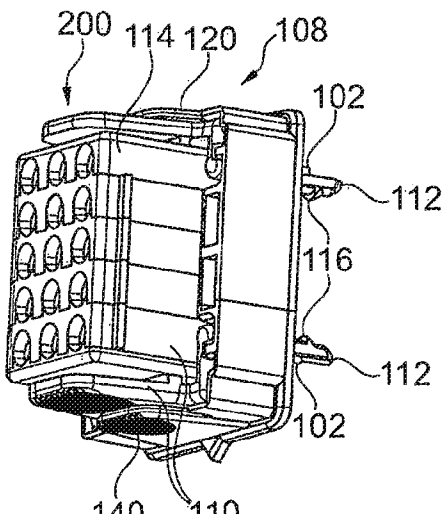
Figure 13:
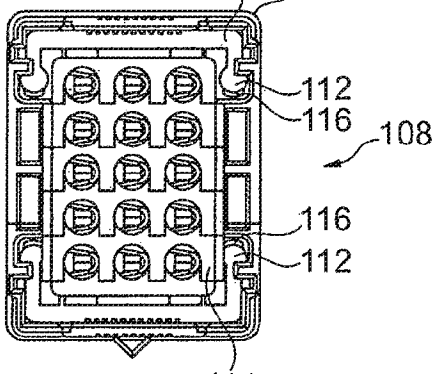
Figures 16, 17, 18, 19, 20, 21:
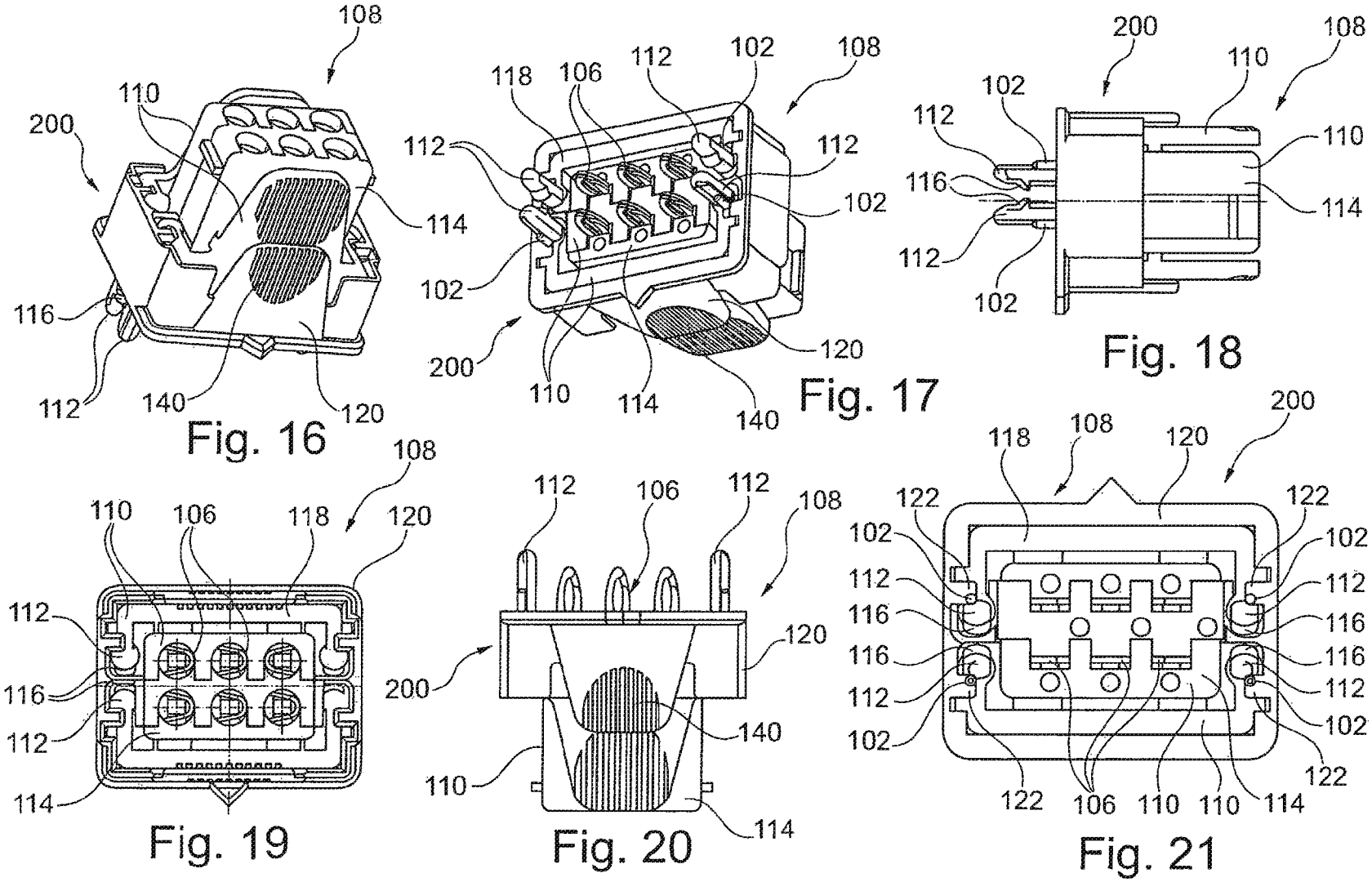
FIG. 16 to FIG. 21 show different views of a direct plug device in accordance with another exemplary embodiment in which the connector and receptacle are in a 6-pole configuration.

FIG. 9 shows a spatial view of three sub-housings 900, 910 and 920, which can be connected together in order to form the plug element 110 of the direct plug device 100 in accordance with the previous Figures. Sub-housing 900 forms a left-hand side component, sub-housing 910 forms a central component and sub-housing 920 forms a right-hand side component of the plug element 110. Each of the sub-housings 900, 910 and 920 comprises a body that forms a part of the accommodating housing 114.

The contact elements 106 (not shown in FIG. 9) can be inserted into accommodating spaces in the form of rectangular-shaped recesses in connection sections of the sub-housings 900, 910 and 920, and by assembling the associated sub-housings 900, 910, 920 together, they can be subsequently mounted with a clamping action at the housing 114 thus formed. Sub-components of the pre-adjusting housing 118 are formed integrally at the two peripherally arranged sub-housings 900, 920, and are elastically connected thereto using bridge elements (not visible in FIG. 9).

FIG. 10 to FIG. 15 show different views of a direct plug device 108 in accordance with an exemplary embodiment, in which the plug and receptacle are in a 15-pole configuration, i.e. in which 15 contact elements 106 are provided.

FIG. 16 to FIG. 21 show different views of a direct plug device 108 in accordance with another exemplary embodiment in which the connector and receptacle are in a 6-pole configuration.

It will be clear to the person skilled in the art that the 9-pole, 15-pole and 6-pole configurations that have been described in detail with reference to the Figures are only examples, and that any number of one or more poles or contact elements 106 can be realized in a direct plug device according to embodiments of the invention.

It is also noted that "comprising" does not exclude any other elements or steps, and "a" or "an" does not exclude a plurality. It should also be noted that features or steps, which have been described with reference to any one of the above examples, can also be used in combination with other features or steps of other exemplary embodiments described above. Reference numerals in the claims are not to be regarded as restrictive.

The invention claimed is:

1. Direct plug device for directly plugging onto a printed circuit board, wherein the direct plug device comprises:

a plug element, which comprises an accommodating housing and at least one pluggable, in particular spring-like, contact element accommodated at it;

a plug element receptacle, which is designed to at least partially accommodate the plug element, which comprises a locking device and which is moveable relative to the plug element between a contact element-remote state and a contact element-proximal state;

wherein the plug element comprises at least one pre-adjusting structure which is to be arranged at the side of the printed circuit board and which, when the plug element is placed onto the printed circuit board, can be connected to at least one corresponding pre-adjusting structure of the printed circuit board in such a way that, in the connected state, the at least one contact element is aligned with at least one correspondingly designed contact element opening of the printed circuit board;

wherein the plug element receptacle can be displaced relative to the plug element, which is placed on the printed circuit board in a pre-adjusted manner, from the contact element-remote state to the contact element-proximal state in such a way that thereby the locking device and the pre-adjusting structure of the plug element are commonly locked to the pre-adjusting structure of the printed circuit board.

2. Direct plug device as set forth in claim 1, wherein the plug element receptacle can be displaced relative to the plug element, which is placed on the printed circuit board, in a pre-adjusted manner from the contact element-remote state to the contact element-proximal state in such a way that thereby the locking device locks the pre-adjusting structure of the plug element to the pre-adjusting structure of the printed circuit board with an interlocking and/or a force-fitting and/or a frictionally-engaged connection.

3. Direct plug device as set forth in claim 1, wherein the plug element and the plug element receptacle are designed in such a way that, starting from a state in which the locking device locks the pre-adjusting structure of the plug element to the pre-adjusting structure of the printed circuit board, the plug element receptacle can be displaced from the contact element-proximal state to the contact element-remote state in such a way that the locking is released and the plug element can then be disconnected from the printed circuit board.

4. Direct plug device as set forth in claim 1, wherein the plug element and the plug element receptacle are matched to each other in such a way that a printed circuit board contact surface of the accommodating housing and a printed circuit board contact surface of the plug element receptacle are coplanar with each other in the contact element-proximal state.

5. Direct plug device as set forth in claim 1, wherein the plug element receptacle is formed from an electrically insulating material, in particular from plastic.

6. Direct plug device as set forth in claim 1, wherein the at least one pre-adjusting structure of the plug element comprises at least one pre-adjusting pin and the at least one corresponding pre-adjusting structure of the printed circuit board comprises at least one pre-adjusting opening.

7. Direct plug device as set forth in claim 6, wherein the at least one pre-adjusting pin comprises a lateral protrusion, which, after the pre-adjusting pin has been passed, starting from a front side of the printed circuit board, through the printed circuit board, and by subsequent movement of the plug element receptacle from the contact element-remote state to the contact element-proximal state, abuts against a rear side of the printed circuit board where it is locked to prevent withdrawal.

8. Direct plug device as set forth in claim 1, wherein the at least one contact element protrudes relative to the accommodating housing at the side of the printed circuit board, in particular such that it is non-displaceable in the plugging direction and/or spring-like moveable perpendicular to the plugging direction.

9. Direct plug device as set forth in claim 8, wherein the pre-adjusting structure of the plug element extends protectively beyond the at least one contact element at the side of the printed circuit board.

10. Connection arrangement, comprising:

a printed circuit board, which has at least one pre-adjusting structure and at least one contact element opening;

a direct plug device as set forth in claim 1, which is designed for directly plugging on the printed circuit board by means of a connection of the at least one pre-adjusting structure of the plug element to the at least one corresponding pre-adjusting structure of the printed circuit board and by means of a subsequent displacement of the plug element receptacle relative to the plug element and relative to the printed circuit board from the contact element-remote state to the contact element-proximal state in such a way that the locking device and the pre-adjusting structure of the plug element are thereby commonly locked to the pre-adjusting structure of the printed circuit board.

11. Connection arrangement as set forth in claim 10, wherein the printed circuit board is free of sockets, at least in the region of the at least one contact element opening and/or at least in the region of the at least one pre-adjusting structure of the printed circuit board.

12. Method for directly plugging a direct plug device onto a printed circuit board, wherein the method comprises:

providing a plug element, which comprises an accommodating housing and at least one pluggable, in particular spring-like, contact element accommodated at it;

accommodating the plug element at least partially, by means of a plug element receptacle, which has a locking device and which can be displaced relative to the plug element between a contact element-remote state and a contact element-proximal state;

placing the plug element on the printed circuit board, whereby at least one pre-adjusting structure of the plug element at the side of the printed circuit board is connected to at least one corresponding pre-adjusting structure of the printed circuit board in such a way that due to the connection the at least one contact element is aligned with at least one correspondingly designed contact element opening in the printed circuit board;

displacing the plug element receptacle relative to the plug element, which is placed on the printed circuit board in a pre-adjusted manner, from the contact element-remote state to the contact element-proximal state, in such a way that the locking device and the pre-adjusting structure of the plug element are commonly locked to the pre-adjusting structure of the printed circuit board.

* * * * *